US009886903B2

(12) United States Patent
Takahashi et al.

(10) Patent No.: US 9,886,903 B2
(45) Date of Patent: Feb. 6, 2018

(54) DISPLAY APPARATUS AND DISPLAY METHOD

(71) Applicant: Samsung Display Co., LTD., Yongin-si, Gyeonggi-Do (KR)

(72) Inventors: Seiki Takahashi, Yokohama (JP); Takeshi Okuno, Yokohama (JP); Eiji Kanda, Yokohama (JP)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 142 days.

(21) Appl. No.: 14/962,302

(22) Filed: Dec. 8, 2015

(65) Prior Publication Data

US 2016/0163260 A1 Jun. 9, 2016

(30) Foreign Application Priority Data

Dec. 8, 2014 (JP) ..... 2014-247996
Dec. 8, 2014 (JP) ..... 2014-247997

(51) Int. Cl.
*G09G 3/3233* (2016.01)

(52) U.S. Cl.
CPC ... *G09G 3/3233* (2013.01); *G09G 2300/0852* (2013.01); *G09G 2300/0861* (2013.01); *G09G 2310/0251* (2013.01); *G09G 2310/0262* (2013.01); *G09G 2360/148* (2013.01)

(58) Field of Classification Search
CPC ..... G09G 3/3233; G09G 2300/0852; G09G 2360/148; G09G 2310/0251; G09G 2310/0262; G09G 2300/0861
See application file for complete search history.

(56) References Cited

U.S. PATENT DOCUMENTS 7,554,514 B2 6/2009 Nozawa
2012/0236041 A1* 9/2012 Oh ..... G09G 3/3258 345/690

FOREIGN PATENT DOCUMENTS

| | | | |
|---|---|---|---|
| EP | 0923067 | B1 | 8/2004 |
| JP | 2001524090 | A | 11/2001 |
| JP | 2006506307 | A | 2/2006 |
| JP | 2009238833 | A | 10/2009 |
| JP | 2010139895 | A | 6/2010 |

* cited by examiner

*Primary Examiner* — Shaheda Abdin
(74) *Attorney, Agent, or Firm* — Cantor Colburn LLP

(57) ABSTRACT

The pixel circuit includes a light-emitting element, an optical sensor for detecting a luminance of light emitted from the light-emitting element, and a compensation control circuit which controls the amount of the current supplied to the light-emitting element on the basis of a detection result of the optical sensor and a second voltage applied in a second interval different from a first interval with a predetermined length in which the light-emitting element is allowed to constantly emit light with a luminance based on a first voltage, and includes a first control circuit and a second control circuit where the first control circuit controls a first current amount for enabling the light-emitting element to emit light and the second control circuit controls a second current amount supplied to the light-emitting element.

15 Claims, 12 Drawing Sheets

DISPLAY APPARATUS AND DISPLAY METHOD

This application claims priority to Japanese Patent Application No. 2014-247996, filed on Dec. 8, 2014, and Japanese Patent Application No. 2014-247997, filed on Dec. 8, 2014, and all the benefits accruing therefrom under 35 U.S.C. §119, the contents of which in their entirety are herein incorporated by reference.

BACKGROUND

1. Field

Exemplary embodiments of the invention herein relate to a display apparatus and a display method.

2. Description of the Related Art

Recently developed is a flat panel display apparatus in which pixels including self-emitting elements such as organic light-emitting diodes ("OLEDs") are arranged in a matrix.

It is known that a self-light-emitting element (hereinafter also referred to as a "light-emitting element") such as an OLED deteriorates in proportion to a luminance and a light-emitting time thereof. Since an image displayed on a display apparatus is not uniform, OLEDs deteriorate differently from each other. A light-emitting element that displays a high-luminance color such as white tends to easily deteriorate compared to a light-emitting element that displays a low-luminance color such as black, for example.

When the deterioration of a light-emitting element is in progress, the luminance of the light-emitting element tends to become lower than that of a light-emitting element that deteriorates relatively more slowly. As a result, for example, when a uniform color is displayed after a certain pattern is displayed for a long time, the pattern may remain to be visually recognized. Such a phenomenon is generally known as "image sticking (or burn-in)".

Japanese Patent Application Laid-open Publication No. 2001-524090 (Patent Document 1) discloses an exemplary technology for reducing a luminance difference between pixels due to the deterioration of the pixels. That is, according to the technology disclosed in Patent Document 1, a part of the light from a light-emitting element is received by a photodiode as part of a pixel circuit, and the amount of current supplied to the light-emitting element is controlled on the basis of a result of the reception of light, thereby compensating for luminance deterioration of the light-emitting element.

For another example, according to the technology disclosed in Japanese Patent Application Laid-open Publication No. 2006-506307 (Patent Document 2), a part of the light from a light-emitting element is received by a photodiode as part of a pixel circuit, and a light-emitting time (duty ratio) of the light-emitting element is controlled on the basis of a result of the reception of light, thereby compensating for luminance deterioration of the light-emitting element.

SUMMARY

According to the technology disclosed in Patent Document 1, since a transistor for controlling the amount of current supplied to a light-emitting element is operated in a saturation region, characteristics of the transistor are changed, causing unstable operation. Further, according to the technology disclosed in Patent Document 2, since a light-emitting amount of a light-emitting element is controlled by regulating the duty ratio when light is emitted, a contour that is not originally included (i.e., a false contour) in a video may be observed when the video is displayed.

The invention provides a technology for preventing the occurrence of a false contour.

The invention also provides a display apparatus and a display method for desirably compensating for the amount of light emission of a light-emitting element according to the amount of deterioration of the light-emitting element for each pixel.

An exemplary embodiment of the invention provides display apparatuses having pixel circuits arranged in a matrix, each of the pixel circuits including a light-emitting element which emits light with a luminance based on an amount of current, an optical sensor which detects the luminance of the light emitted from the light-emitting element, and a compensation control circuit which controls the amount of the current supplied to the light-emitting element on the basis of a detection result of the optical sensor and a second voltage applied in a second interval different from a first interval with a predetermined length during a light emission interval of the light-emitting element, where, in the first interval, the light-emitting element is allowed to constantly emit light with a luminance based on a first voltage.

In an exemplary embodiment, the compensation control circuit may include a capacitor which maintains the second voltage applied, and a light emission control transistor which controls an amount of current that flows between a source and a drain thereof on the basis of a gate voltage determined according to the second voltage maintained in the capacitor and the detection result of the optical sensor during the second interval.

In an exemplary embodiment, a discharge interval of the second voltage maintained in the capacitor may be controlled according to the detection result of the optical sensor, and a length of the second interval may be controlled on the basis of the discharge interval.

In an exemplary embodiment, the optical sensor may be connected in parallel to the capacitor, where one terminal of the optical sensor and one terminal of the capacitor may be connected to a gate terminal of the light emission control transistor, where the second voltage applied to the gate terminal of the light emission control transistor may be maintained in the capacitor during the first interval.

In an exemplary embodiment, the display apparatus may further include a switching element which determines whether to apply the second voltage to the gate terminal of the light emission control transistor, where, in the first interval, the switching element may be turned on, and, in the second interval, the switching element may be turned off, so that the gate terminal of the light emission control transistor may be floated.

In an exemplary embodiment, each of the pixel circuits may include a driving transistor for controlling an amount of current that flows between a source and a drain thereof on the basis of the first voltage applied to a gate terminal of the driving transistor, where the amount of the current supplied to the light-emitting element may be controlled on the basis of the driving transistor and the compensation control circuit.

In an exemplary embodiment, the driving transistor may be disposed at a front stage of the compensation control circuit, where the compensation control circuit may control the amount of the current supplied to the light-emitting element on the basis of current supplied through the driving transistor.

In an exemplary embodiment of the invention, a method for displaying an image on a display apparatus having pixel circuits arranged in a matrix, each of the pixel circuits including a light-emitting element which emits light with a luminance based on an amount of current and an optical sensor which detects the luminance of the light emitted from the light-emitting element includes making the light-emitting element emit light constantly with a luminance based on a first voltage for controlling the luminance of the light-emitting element in a first interval with a predetermined length during a light emission interval of the light-emitting element, and controlling the amount of the current supplied to the light-emitting element on the basis of a detection result of the optical sensor and a second voltage applied in a second interval different from the first interval.

In an exemplary embodiment of the invention, a display apparatus includes pixel circuits arranged in a matrix, where each of the pixel circuits includes a light-emitting element, an optical sensor, a first control circuit, and a second control circuit.

The light-emitting element may emit light with a luminance based on an amount of current. The optical sensor detects the luminance of the light emitted from the light-emitting element. The first control circuit receives a first voltage for controlling the luminance of the light-emitting element to control a first current amount for enabling the light-emitting element to emit light. The second control circuit receives a second voltage determined according to the first voltage, and controls a second current amount supplied to the light-emitting element on the basis of a detection result of the optical sensor and the second voltage according to the first current amount.

BRIEF DESCRIPTION OF THE DRAWINGS

The accompanying drawings are comprised to provide a further understanding of the invention, and are incorporated in and constitute a part of this specification. The drawings illustrate exemplary embodiments of the invention and, together with the description, serve to explain principles of the invention. In the drawings.

DETAILED DESCRIPTION

Figure 1:
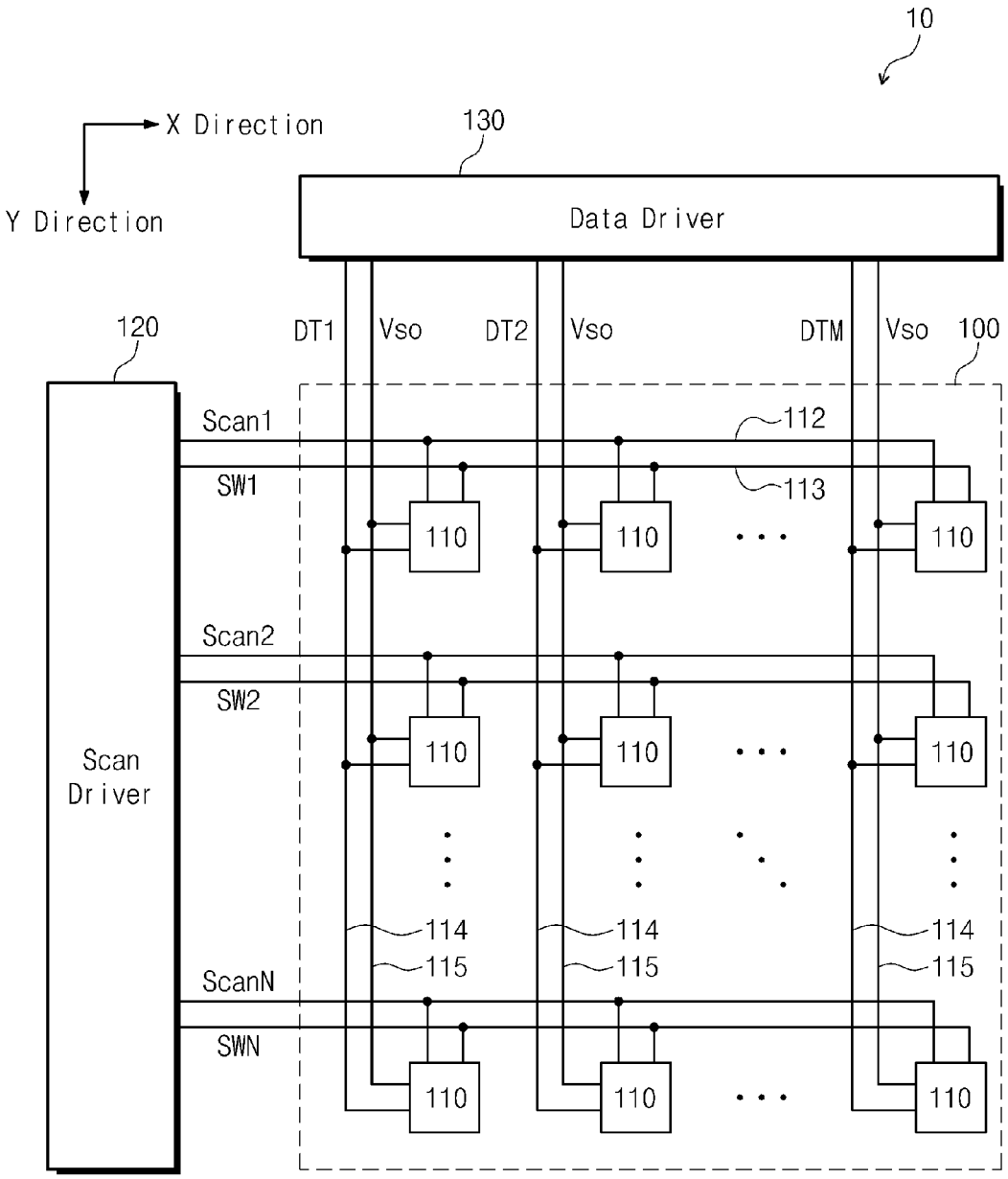
FIG. 1 is a diagram illustrating an exemplary configuration of a display apparatus according to an exemplary embodiment of the invention.

Exemplary embodiments of the invention will be described in detail with reference to the accompanying drawings. In the description and the drawings, elements that have substantially the same configuration are referred to by the same reference numeral to avoid overlapping descriptions.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" or "beneath" can encompass both an orientation of above and below. The device may be otherwise oriented and the spatially relative descriptors used herein interpreted accordingly.

It will be understood that, although the terms first, second, third, etc., may be used herein to describe various elements, these elements should not be limited by these terms. These terms are only used to distinguish one element from another element. Thus, a first element discussed below could be termed a second element without departing from the teachings of the present invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

<1. Configuration of Display Apparatus>

An exemplary schematic configuration of a display apparatus according to an exemplary embodiment of the invention will be described with reference to FIG. 1. FIG. 1 is a diagram illustrating an exemplary configuration of a display apparatus according to the exemplary embodiment of the invention. In FIG. 1, a horizontal direction may be referred to as a row direction (e.g., X direction), and a vertical direction may be referred to as a column direction (e.g., Y direction). As illustrated in FIG. 1, a display apparatus 10 according to the exemplary embodiment of the invention includes a display unit 100, a scan driver 120, and a data driver 130.

The display unit 100 includes a plurality of pixel circuits 110. The display unit 100 displays an image corresponding to a data signal on display pixels provided by the pixel circuits 110. In the display unit 100, a plurality of row scanning lines 112 and a plurality of compensation control signal lines 113 extend in the row direction (X direction). Furthermore, in the display unit 100, a plurality of data lines 114 and a plurality of compensation voltage signal lines 115 extend in column direction (Y direction). Herein, it is assumed that N (N is an integer not smaller than 2) number of the row scanning lines 112, N number of the compensation control signals lines 113, M (M is an integer not smaller than 2) number of the column data lines 114, and M number of the compensation voltage signal lines 115 are arranged in the display unit 100.

The pixel circuits 110 are respectively arranged at locations corresponding to intersections of the scanning lines 112 extending in the row direction (e.g., X direction) and the data lines 114 extending in the column direction (e.g., Y direction). A detailed configuration of the pixel circuit 110 will be described later.

The display unit 100 is supplied with a first power supply voltage VDD (refer to FIG. 2), a second power supply voltage VSS (refer to FIG. 2), and a reference voltage GND (refer to FIG. 2) from an upper-level control circuit not shown. In an exemplary embodiment, the first and second power supply voltages VDD and VSS are signals for supplying current for enabling a light-emitting element included in the pixel circuit 110 to emit light.

The scanning lines 112 and the compensation control signal lines 113 arranged in the Y direction are connected to the scan driver 120. The scan driver 120 supplies a signal SCAN to each pixel circuit 110 corresponding to each row through the scanning line 112 disposed for each row. Furthermore, the scan driver 120 supplies a signal SW to each pixel circuit 110 corresponding to each row through the compensation control signal 113 disposed for each row. The signal SCAN and the signal SW will be further described later.

The data lines 114 and the compensation voltage signal lines 115 arranged in the X direction are connected to the data driver 130. Through the data line 114 disposed for each column, the data driver 130 may supply a signal DT to each pixel circuit 110 corresponding to each column according to a luminance of emitted light (or gradation). Furthermore, through the compensation voltage signal line 115 disposed for each column, the data driver 130 applies an initial sensor voltage Vso pre-adjusted to a predetermined potential to each pixel circuit 110 corresponding to each column. The signal DT and the initial sensor voltage Vso will be further described later.

<2. Configuration of Pixel Circuit>

Figure 2:
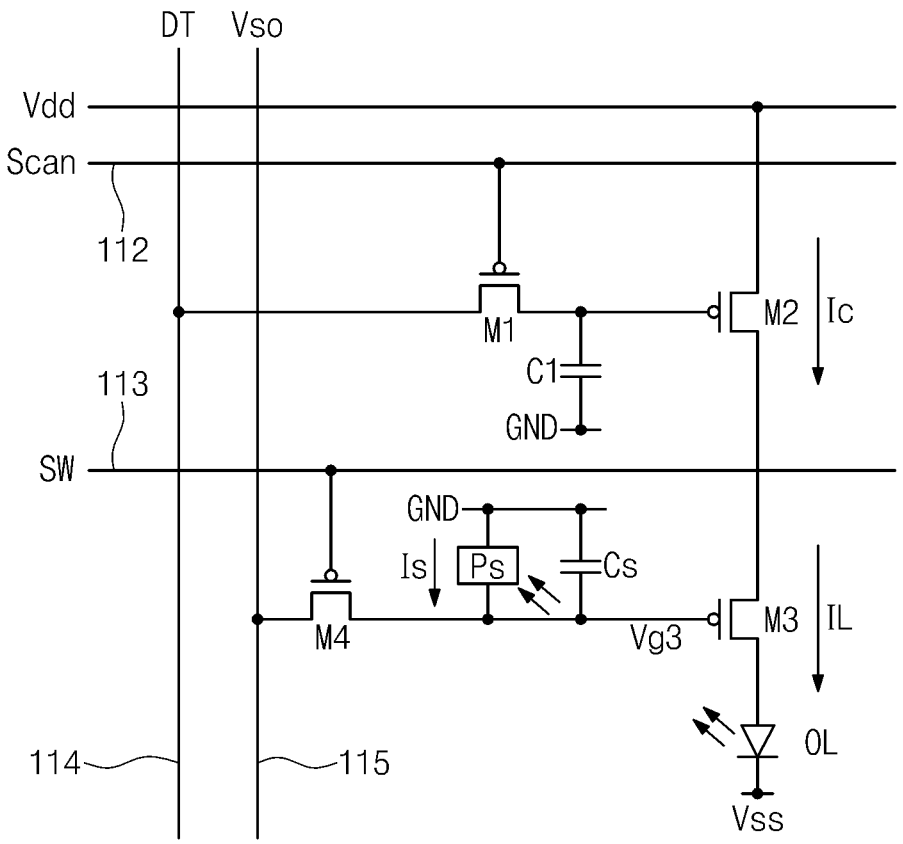
FIG. 2 is a diagram illustrating an exemplary configuration of the exemplary embodiment of a pixel circuit according to invention.

An exemplary configuration of a pixel circuit according to the exemplary embodiment of the invention will be described with reference to FIG. 2. FIG. 2 is a diagram illustrating an exemplary configuration of a pixel circuit according to the exemplary embodiment of the invention.

FIG. 2 illustrates an example of the pixel circuit 110 disposed at a location corresponding to an intersection of an ith row and a jth column among the pixel circuits 110 included in the display unit 100 illustrated in FIG. 1. Since the other pixel circuits 110 may have the same configuration as that of the pixel circuit 110 of FIG. 2, detailed descriptions of the other pixel circuits 110 are not provided.

As illustrated in FIG. 2, the pixel circuit 110 includes an organic light-emitting diode ("OLED") OL, a retention capacitor C1, a switching transistor M1, a driving transistor M2, an optical sensor Ps, a sensor capacitor Cs, a light emission control transistor M3, and a switching transistor M4.

In an exemplary embodiment, the driving transistor M2 and the light emission control transistor M3 may be, for example, P-channel-type metal-oxide semiconductor field-effect transistors ("MOSFETs").

As illustrated in FIG. 2, a drain terminal of the driving transistor M2 is connected to a source terminal of the light emission control transistor M3, and a source terminal of the driving transistor M2 is connected to a signal line for supplying the first power supply voltage VDD. A drain terminal of the light emission control transistor M3 is connected to an anode of the OLED OL. A cathode of the OLED OL is connected to the second power supply voltage VSS.

A source terminal of the switching transistor M1 is connected to the data line 114, and a drain terminal of the switching transistor M1 is connected to a gate terminal of the driving transistor M2. The switching transistor M1 is turned on/off by the signal SCAN transferred to a gate terminal of the switching transistor M1 through the scanning line 112.

One terminal of the retention capacitor C1 is connected to the gate terminal of the driving transistor M2, and the other terminal of the retention capacitor C1 is connected to the reference voltage GND. The retention capacitor C1 maintains a potential of the driving transistor M2.

That is, as the switching transistor M1 is turned on, the signal DT based on the luminance of emitted light (or gradation) is transferred from the data driver 130 (refer to FIG. 1) to the gate terminal of the driving transistor M2 through the data line 114. Thereafter, as the switching transistor M1 is turned off, the signal DT transferred through the data line 114 is maintained in the retention capacitor C1.

A source terminal of the switching transistor M4 is connected to the compensation voltage signal line 115, and a drain terminal of the switching transistor M4 is connected to a gate terminal of the light emission control transistor M3. The switching transistor M4 is turned on/off by the signal SW transferred to a gate terminal of the switching transistor M4 through the compensation control signal line 113.

In an exemplary embodiment, the optical sensor Ps may include, for example, a photodiode or a phototransistor. In an exemplary embodiment, polysilicon, amorphous silicon, or the like may be used as a material of the optical sensor Ps. One terminal of the optical sensor Ps is connected to the gate terminal of the light emission control transistor M3, and the other terminal of the optical sensor Ps is connected to the reference voltage GND. The optical sensor Ps is disposed such that a part of light from the OLED OL is irradiated to the optical sensor Ps.

One terminal of the sensor capacitor Cs is connected to the gate terminal of the light emission control transistor M3, and the other terminal of the sensor capacitor Cs is connected to the reference voltage GND. One the basis of such a configuration, the sensor capacitor Cs maintains a potential Vg3 of the gate terminal of the light emission control transistor M3.

Once the switching transistor M4 is turned on, the initial sensor voltage Vso (Vso<0) pre-adjusted to a predetermined potential is applied from the data driver 130 (refer to FIG. 1) to the gate terminal of the light emission control transistor M3 through the compensation voltage signal line 115. The initial sensor voltage Vso corresponds to an example of a "second voltage". The initial sensor voltage Vso may be set at a sufficiently low voltage so that the light emission control transistor M3 is operated in a linear region.

Then, the light emission control transistor M3 is turned on, and the driving transistor M2 is selectively turned on according to the signal DT transferred from the data line 114 and maintained in the retention capacitor C1. Furthermore, a driving current Ic based on the signal DT maintained in the retention capacitor C1 is supplied to the OLED OL through the light emission control transistor M3. A light emission state of the OLED OL is controlled by the light emission control transistor M3. Hereinafter, a current that flows between the drain and the source of the light emission control transistor M3 may be referred to as a current IL in the case where the current that flows between the drain and the source of the light emission control transistor M3 is specifically differentiated from the driving current Ic.

Thereafter, once the switching transistor M4 is turned off, the gate terminal of the light emission control transistor M3 is floated. Accordingly, the initial sensor voltage Vso applied through the compensation voltage signal line 115 is maintained in the sensor capacitor Cs. Furthermore, at this time, the light emission control transistor M3 is turned on, and the current IL that flows between the drain and the source of the light emission control transistor M3 is equal to Ic.

Thereafter, the initial sensor voltage Vso maintained in the sensor capacitor Cs is discharged by the sensing current Is based on a detection result of the optical sensor Ps. Due to the discharge, the gate voltage Vg3 of the light emission control transistor M3 becomes higher than the initial sensor voltage Vso. Furthermore, when the gate voltage Vg3 reaches a threshold voltage Vth3 (refer to FIG. 3) of the light emission control transistor M3, the light emission control transistor M3 is turned off, and the current IL becomes 0 (i.e., the OLED OL is turned off).

A time taken for the light emission control transistor M3 to be turned off after the switching transistor M4 is turned off is determined according to a relation between the sensing current Is and the sensor capacitor Cs. In detail, as the luminance of the OLED OL becomes higher, an amount of the sensing current Is increases, and a discharge time of the sensor capacitor Cs becomes shorter. In other words, as the luminance of the OLED OL becomes lower, the amount of the sensing current Is decreases, and the discharge time of the sensor capacitor Cs becomes longer.

Therefore, for example, in the case where the luminance of the OLED OL decreases due to deterioration thereof, the amount of the sensing current Is decreases, and the discharge time of the sensor capacitor Cs becomes longer. Accordingly, after deterioration of the OLED OL, a period of time in which the light emission control transistor M3 is turned on is longer than before the deterioration, so that an effective luminance of the OLED OL increases, thereby compensating for the luminance deterioration of the OLED OL.

An exemplary configuration of a pixel circuit according to the exemplary embodiment of the invention has been described with reference to FIG. 2.

<3. Driving Timing>

Figure 3:
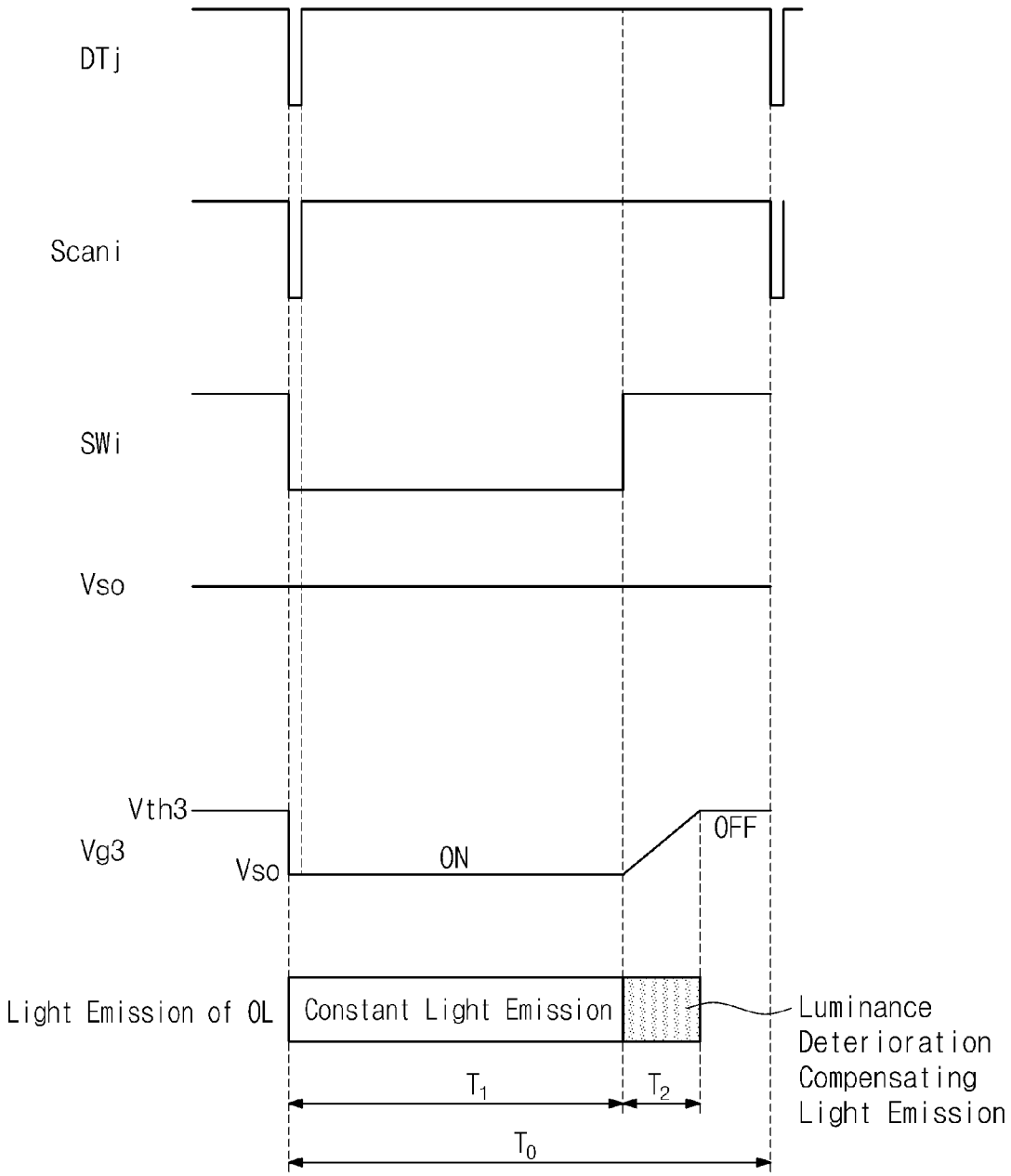
FIG. 3 is a schematic timing chart illustrating an exemplary driving timing of the exemplary embodiment of a pixel circuit according to the invention.

An exemplary driving timing of each element of the pixel circuit 110 of FIG. 2 will be described with reference to FIG. 3. FIG. 3 is a schematic timing chart illustrating an exemplary driving timing of the pixel circuit 110 according to the exemplary embodiment of the invention. The pixel circuit 110 located at an intersection of the ith row and the jth column is described below as an example. Since the other pixel circuits 110 are the same as the exemplary pixel circuit 110, detailed descriptions of the other pixel circuits 110 are not provided.

In FIG. 3, a reference sign T0 represents a light emission interval for displaying an image by making the OLED OL emit light during an interval of one frame. For convenience, in the timing chart of FIG. 3, the light emission interval $T_0$ of the OLED OL is shown as the interval of one frame, and other intervals for a control operation are not shown. Therefore, a control interval or the like for compensating for a change in a threshold value of a driving transistor may be provided in addition to the light emission interval $T_0$ during the interval of one frame.

As illustrated in FIG. 3, the light emission interval $T_0$ is divided into a constant light emission interval $T_1$ and a luminance deterioration compensating light emission interval $T_2$ so that the pixel circuit 110 according to the exemplary embodiment of the invention is controlled according to the intervals. The constant light emission interval $T_1$ represents an interval in which the OLED OL is enabled to constantly emit light on the basis of the constant current Ic. The constant current Ic is determined by the signal DT based on the luminance of emitted light (or gradation). In the luminance deterioration compensating light emission interval $T_2$, the amount of the current IL supplied to the OLED OL and an interval in which the current IL is supplied are controlled according to a detection result of the optical sensor Ps so that the luminance deterioration of the OLED OL is compensated for. The constant light emission interval $T_1$ corresponds to an example of a "first interval". The luminance deterioration compensating light emission interval $T_2$ corresponds to an example of a "second interval".

Here, each timing of FIG. 3 is described below in relation to the configuration of the pixel circuit 110 of FIG. 2.

As illustrated in FIG. 3, the switching transistor M1 of the pixel circuit 110 is turned on by an L-level signal SCAN (e.g., SCANi) supplied through the scanning line 112 of the ith row. Accordingly, the signal DT based on the luminance of emitted light (or gradation) is transferred to the gate terminal of the driving transistor M2 of the pixel circuit 110 through the data line 114 of the jth column. Furthermore, when the signal SCAN reaches an H level, the switching transistor M1 is turned off, and the signal DT (i.e., DTj) transferred through the data line 114 is maintained in the retention capacitor C1. The signal DT maintained in the retention capacitor C1 corresponds to an example of a "first voltage".

As described above, the signal DT based on the luminance of emitted light is maintained in the retention capacitor C1 in synchronization with the signal SCAN. An interval in which the signal SCAN is at an L level and the signal DT is maintained in the retention capacitor C1 (i.e., data is written to the pixel circuit 110) may be about 10 microseconds (μs). However, the interval in which the signal DT is maintained in the retention capacitor C1 is not limited thereto, and may vary with the number of the pixel circuits 110 (i.e., a pixel number) included in the display unit 100.

Furthermore, in synchronization with initiation of supplying of the L-level signal SCAN, an L-level signal SW (i.e., SWi) starts to be supplied through the compensation control signal line 113 of the ith row, and the switching transistor M4 of the pixel circuit 110 is turned on. Then, the initial sensor voltage Vso (Vso<0) pre-adjusted to a predetermined potential is applied as the gate voltage Vg3 to the gate terminal of the light emission control transistor M3 of the pixel circuit 110 through the compensation voltage signal line 115 of the jth column. The initial sensor voltage Vso will be described in detail with reference to FIG. 5.

Then, the light emission control transistor M3 is turned on, and the driving transistor M2 is selectively turned on according to the signal DT (i.e., DTj) transferred from the data line 114 and maintained in the retention capacitor C1. Furthermore, the driving current Ic based on the signal DT maintained in the retention capacitor C1 is supplied to the OLED OL through the light emission control transistor M3. Therefore, the OLED OL emits light with a luminance according to the driving current Ic.

An interval in which the OLED OL emits light with a luminance according to the driving current Ic corresponds to the constant light emission interval $T_1$. That is, the constant light emission interval $T_1$ corresponds to an interval in which the switching transistor M4 is turned on by the L-level signal SW, and the light emission control transistor M3 is driven on the basis of the initial sensor voltage Vso.

Thereafter, when the signal SW reaches an H level, the switching transistor M4 is turned off, and the initial sensor voltage Vso applied through the compensation voltage signal line 115 is maintained in the sensor capacitor Cs.

Thereafter, the initial sensor voltage Vso maintained in the sensor capacitor Cs is discharged by the sensing current Is based on a detection result of the optical sensor Ps. Due to the discharge, the gate voltage Vg3 of the light emission control transistor M3 becomes higher than the initial sensor voltage Vso. Furthermore, when the gate voltage Vg3 reaches the threshold voltage Vth3 of the light emission control transistor M3, the light emission control transistor M3 is turned off, and the current IL becomes 0 (i.e., the OLED OL is turned off).

Moreover, the initial sensor voltage Vso maintained in the sensor capacitor Cs is discharged by the sensing current Is based on a detection result of the optical sensor Ps. Accordingly, an interval in which the gate voltage Vg3 of the light emission control transistor M3 is controlled corresponds to the luminance deterioration compensating light emission interval $T_2$. As described above, a length of the luminance deterioration compensating light emission interval $T_2$ corresponds to the discharge time of the sensor capacitor Cs. In addition, the length of the luminance deterioration compensating light emission interval $T_2$ is determined according to a relation between the sensing current Is and the sensor capacitor Cs.

As described above, in the example of FIG. 3, the pixel circuit 110 is driven with a duty ratio of $(T_1+T_2)/T_0$. As the constant light emission interval $T_1$ is longer (i.e., as an interval in which the signal SW is at an L level is longer), the duty ratio is higher. Therefore, the constant light emission interval $T_1$ may be set to be relatively long so as to prevent occurrence of a false contour.

The above-mentioned series of operations may be performed by a program for operating a central processing unit ("CPU") for operating each element of the display apparatus 10. The program may be run by an operating system ("OS") installed in the apparatus. A storage location of the program is not limited when it is readable by a device including an element for performing the above-mentioned processing. In an exemplary embodiment, the program may be stored in a recording medium accessed from the outside of the apparatus. In this case, the recording medium in which the program is stored may be allowed to be accessed by the apparatus so that a CPU of the apparatus executes the program.

An exemplary driving timing of each element of the pixel circuit 110 of FIG. 2 has been described with reference to FIG. 3.

<4. Principle of Compensation for Luminance Deterioration>

With reference to the configuration of the pixel circuit 110 illustrated in FIG. 2, a principle of operation of the display apparatus 10 for compensating for the luminance deterioration of the OLED OL will be described on the basis of simple model equations.

Firstly, described below is a first model based on the fact that a resistance Rs of the optical sensor Ps of the pixel circuit 110 is inversely proportional to the luminance of the OLED OL. In the case where the current IL between the drain and the source of the light emission control transistor M3 is equal to the current Ic, the luminance of the OLED OL is proportional to the current Ic. In the case where the current IL between the drain and the source of the light emission control transistor M3 is equal to 0, the luminance of the OLED OL is 0. A luminance deterioration ratio that represents a ratio of post-deterioration luminance to pre-deterioration luminance is referred to as "a". In this case, in a state in which the OLED OL emits light, the resistance Rs of the optical sensor Ps is expressed as Equation (1) below since the resistance Rs of the optical sensor Ps is inversely proportional to a·Ic. In Equation (1), Krs is a constant for determining a relation between the resistance Rs and a·Ic.

$$Rs = \frac{K_{rs}}{a \cdot Ic} \tag{1}$$

A relation between the gate voltage Vg3 of the light emission control transistor M3 and the resistance Rs of the optical sensor Ps is expressed as Equation (2) below.

$$dV_{g3} = -\frac{Isdt}{Cs} = -\frac{V_{g3}dt}{RsCs} \tag{2}$$

$$\frac{1}{V_{g3}}dV_{g3} = -\frac{dt}{RsCs}$$

Equation (3) below is derived through integral of Equation (2) over t in the interval from 0 to t and integral of Equation (2) over Vg3 in the interval from Vso to Vg3.

$$V_{g3}=V_{so}\exp(-t/CsRs) \tag{3}$$

Equation (4) below is derived by substituting Equation (1) for Equation (3) and letting $t=T_2$ and Vg3=Vth3. In Equation (4), $K_2$ is a constant for determining a relation between a·Ic, the sensor capacitor C2, and a time $T_2$.

$$T_2 = RsCs\ln(V_{so}/V_{th3}) = \frac{CsK_{rs}}{a \cdot Ic}\ln(V_{so}/V_{th3}) = \frac{CsK_2}{a \cdot Ic} \tag{4}$$

$$(K_2 = K_{rs}\ln(V_{so}/V_{th3}))$$

Next, described below is a second model based on the fact that a value of the sensing current Is that flows through the optical sensor Ps (hereinafter also referred to as a "current value Is") is proportional to the luminance of the OLED OL. In the case where the current IL between the drain and the source of the light emission control transistor M3 is equal to the current Ic, the luminance of the OLED OL is proportional to the current Ic. In the case where the current IL between the drain and the source of the light emission control transistor M3 is equal to 0, the luminance of the OLED OL is 0. In addition, in the case where the luminance deterioration ratio is "a", while the OLED OL emits light, the current value Is of the optical sensor Ps is proportional to a·Ic, which is expressed as Equation (5) below. In Equation (5), Kis is a constant for determining a relation between the resistance Is and a·Ic.

$$Is=K_{is}\cdot a\cdot Ic \tag{5}$$

A relation between the gate voltage Vg3 of the light emission control transistor M3 and the current value Is of the optical sensor Ps is expressed as Equation (6) below.

$$dV_{g3} = -\frac{Isdt}{Cs} \tag{6}$$

Equation (7) below is derived through integral of Equation (6) over t in the interval from 0 to t and integral of Equation (6) over Vg3 in the interval from Vso to Vg3.

$$V_{g3} = V_{so} - \frac{Is \cdot t}{Cs} \tag{7}$$

Equation (8) below is derived by substituting Equation (5) for Equation (7) and letting $t=T_2$ and Vg3=Vth3.

$$T_2 = \frac{Cs}{Is}(V_{so} - V_{th3}) = \frac{Cs}{K_{is} \cdot a \cdot Ic}(V_{so} - V_{th3}) = \frac{CsK_2}{a \cdot Ic} \tag{8}$$

$$\left(K_2 = \frac{(V_{so} - V_{th3})}{K_{is}}\right) \tag{8a}$$

As expressed in Equations (4) and (8), the time $T_2$ is expressed as the same equation even when the integer $K_2$ is differently defined with respect to the first and second models. As a result, a luminance L is expressed as Equation (9) below using a proportional coefficient $K_1$ that represents a proportional relation between the luminance L and the current Ic.

$$L = a \cdot K_1 Ic\frac{(T_1 + T_2)}{T_0} = a \cdot K_1 Ic\left(\frac{T_1}{T_0} + \frac{CsK_2}{a \cdot IcT_0}\right) \tag{9}$$

Here, the duty ratio of $(T_1+T_2)/T_0$ described above with reference to FIG. 3 does not exceed about 100%, and is thus expressed as an conditional expression of Equation (10) below.

$$\frac{T_1}{T_0} + \frac{CsK_2}{a \cdot IcT_0} > 1 \rightarrow \frac{T_1}{T_0} + \frac{CsK_2}{a \cdot IcT_0} = 1 \tag{10}$$

In the case where the luminance deterioration ratio is 1 (i.e., no deterioration) on the basis of Equation (9) representing the luminance L and the conditional expression of Equation (10), a pre-deterioration luminance Li of the OLED OL (hereinafter also referred to as an "initial luminance Li") is expressed as Equation (11) below.

$$Li = K_1 Ic\left(\frac{T_1}{T_0} + \frac{CsK_2}{IcT_0}\right) \tag{11}$$

Furthermore, in the case where the luminance deterioration ratio a<1, a post-deterioration luminance Ld of the OLED OL is expressed as Equation (12) below.

$$Ld = a \cdot K_1 Ic\left(\frac{T_1}{T_0} + \frac{CsK_2}{a \cdot IcT_0}\right) \tag{12}$$

Here, on the basis of Equations (11) and (12), a luminance deterioration ratio Ld/Li obtained after compensating for luminance deterioration is expressed as Equation (13) below.

$$Ld/Li = \left(\frac{a \cdot T_1}{T_0} + \frac{CsK_2}{IcT_0}\right) \Big/ \left(\frac{T_1}{T_0} + \frac{CsK_2}{IcT_0}\right) \tag{13}$$

Furthermore, under predetermined conditions of the luminance deterioration ratio "a" and the current Ic, in the case where the duty ratio obtained after deterioration is about 100% (i.e., 1), the post-compensation luminance deterioration ratio Ld/Li may be construed as having a maximum value. Here, a condition for the case where the post-deterioration duty ratio is about 100% (i.e., 1) is expressed as Equation (14) below.

$$\frac{T_1}{T_0} + \frac{CsK_2}{a \cdot IcT_0} = 1 \tag{14}$$

$$K_2 = \frac{a \cdot IcT_0}{Cs}\left(1 - \frac{T_1}{T_0}\right)$$

Furthermore, on that assumption that the maximum value of the post-compensation luminance deterioration ratio Ld/Li is Ld/Li(max), Ld/Li(max) is expressed as Equation (15) below.

$$Ld/Li(\max) = a \Big/ \left(a + (1-a)\frac{T_1}{T_0}\right) \tag{15}$$

Figure 4:
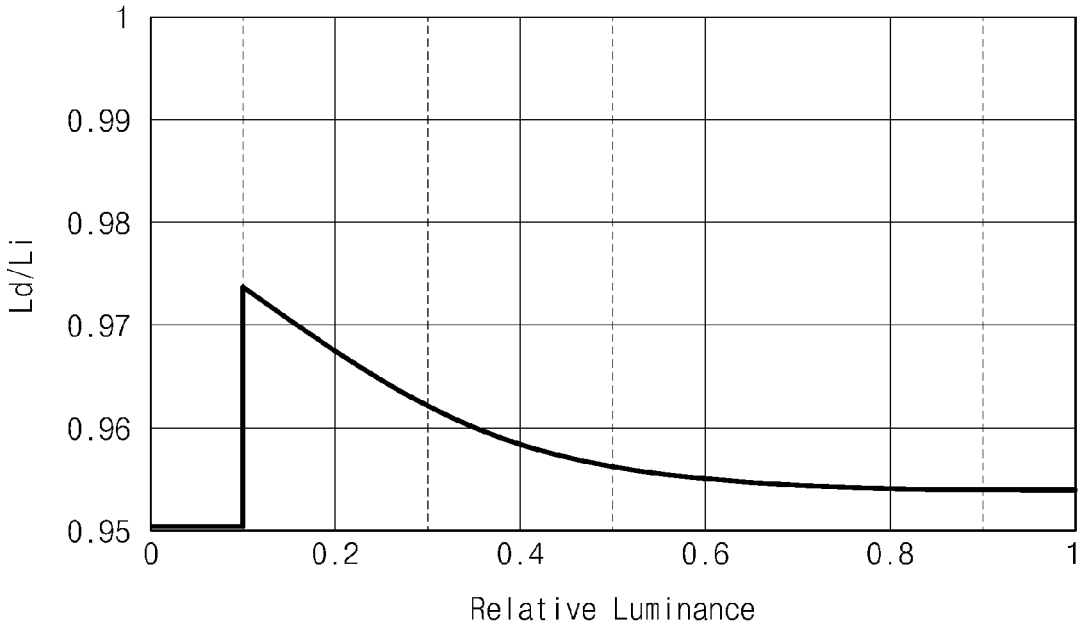
FIG. 4 is a diagram illustrating an exemplary relation between a relative luminance and a post-compensation luminance deterioration ratio regarding of the exemplary embodiment of a display apparatus according to the invention.

FIG. 4 illustrates an exemplary relation between a relative luminance and the post-compensation luminance deterioration ratio Ld/Li, regarding the display apparatus 10 according to the exemplary embodiment of the invention. In FIG. 4, the vertical axis represents the post-compensation luminance deterioration ratio Ld/Li. The horizontal axis represents the relative luminance. Herein, it is assumed that the relative luminance represents a luminance normalized so that a full-white luminance (i.e., a maximum value of a luminance) is about 100%.

It is assumed that the luminance deterioration ratio "a" of the OLED OL is equal to about 0.95, and a ratio of the constant light emission interval $T_1$ to the light emission interval $T_0$ during one frame (i.e., a duty ratio of the constant light emission interval T1) $T_1/T_0$ is equal to about 0.5. Here, FIG. 4 illustrates an exemplary relation between the relative luminance and the post-compensation luminance deterioration ratio Ld/Li in the case where Equation (14) is satisfied at the current value Ic at which the relative luminance is about 10%.

In the example of FIG. 4, when the relative luminance is about 10%, the post-compensation luminance deterioration ratio Ld/Li becomes a maximum value (Ld/Li=0.974) on the basis of Equation (15).

Referring to FIG. 4, it may be understood that, when the relative luminance is lower than a luminance at which the post-compensation luminance deterioration ratio Ld/Li is maximized, the post-compensation luminance deterioration ratio Ld/Li rapidly decreases due to the decrease in the relative luminance and converges to the luminance deterioration ratio "a"=0.95 of the OLED OL. This is because the initial luminance Li at which the duty ratio is not greater than about 100% increases due to a decrease in the current Ic, whereas the duty ratio is fixed to about 100% with respect to the post-deterioration luminance Ld on the basis of Equation (10). Furthermore, regarding the relative luminance lower than a luminance at which the duty ratio is about 100% with respect to the initial luminance Li, the post-compensation luminance deterioration ratio Ld/Li is equal to the luminance deterioration ratio "a" of the OLED OL and has thus a constant value of about 0.95.

On the contrary, when the relative luminance is higher than the luminance at which the post-compensation luminance deterioration ratio Ld/Li is maximized, the post-compensation luminance deterioration ratio Ld/Li slowly decreases due to the increase in the relative luminance. This is because the luminance deterioration compensating light emission interval $T_2$ slowly decreases from $1-T_1/T_0=0.5$ towards 0.

As described above, according to sensitivity characteristics of the optical sensor Ps, design parameters of the optical sensor Ps (e.g., a sensor size, an amount of light irradiated to a sensor, a value of the sensor capacitor Cs, or the like) are optimized in consideration of a target luminance deterioration ratio "a", so as to set the luminance deterioration compensating light emission interval $T_2$. In general, it may be preferable that compensation for luminance deterioration be allowed in a wide luminance range. However, when the relative luminance at which the post-compensation luminance deterioration ratio Ld/Li has a maximum value is decreased, the post-compensation luminance deterioration ratio Ld/Li tends to decrease with respect to a high luminance. Therefore, it may be preferable that a luminance at which the post-compensation luminance deterioration ratio Ld/Li has a maximum value be set within a range from about 10% to about 20%.

Furthermore, as described above, the optical sensor Ps may include, for example, a photodiode or a phototransistor. In general, a photodiode tends to have characteristics similar to those of the second model. A phototransistor tends to have intermediate characteristics between those of the first model and those of the second model.

In the above description, a P-channel-type transistor is exemplarily used as each transistor of the pixel circuit 110 of FIG. 2, but an exemplary embodiment of the invention is not limited thereto. In an exemplary embodiment, an N-channel-type transistor may be used as each transistor of the pixel circuit 110 of FIG. 2. In this case, relations among signals in terms of potential may be modified, as appropriate, according to characteristics of each transistor.

A principle of operation of the display apparatus 10 for compensating for the luminance deterioration of the OLED OL has been described on the basis of simple model equations with reference to FIGS. 2 and 4.

If $T_1/T_0=0$ in Equation (11) (that is, when the length of the constant light emission interval T1 is 0), the initial luminance Li is expressed as Equation (16) below.

$$Li = K_1 Ic\left(\frac{CsK_2}{IcT_0}\right) \tag{16}$$

Likewise, when $T_1/T_0=0$ in Equation (12), the post-deterioration luminance Ld of the OLED OL is expressed as Equation (17) below.

$$Ld = a \cdot K_1 Ic\left(\frac{CsK_2}{a \cdot IcT_0}\right) \tag{17}$$

Here, since the duty ratio of $(T_1+T_2)/T_0$ described above with reference to FIG. 3 does not exceed about 100%, conditional expressions of Equations (18a) and (18b) are provided.

$$\frac{CsK_2}{IcT_0} > 1 \rightarrow \frac{CsK_2}{IcT_0} = 1 \tag{18a}$$

$$\frac{CsK_2}{a \cdot IcT_0} > 1 \rightarrow \frac{CsK_2}{a \cdot IcT_0} = 1 \tag{18b}$$

Accordingly, under a condition not satisfying the left term of Equation (18b), the post-compensation luminance deterioration ratio Ld/Li is 1, and 100% compensation may be possible. However, as the driving current Ic increases, the duty ratio decreases with respect to the initial luminance Li and the post-deterioration luminance Ld. Therefore, in consideration of such a characteristic, the integer $K_2$ may be adjusted so that the duty ratio becomes about 100% after luminance deterioration in order to achieve a relatively high duty ratio, and the post-compensation luminance deterioration ratio Ld/Li maintains a value of 1. The integer $K_2$ for obtaining a 100% duty ratio after luminance deterioration is expressed as Equation (19) below.

$$K_2 = \frac{a \cdot IcT_0}{Cs} \tag{19}$$

Therefore, when Equation (19) is satisfied in the case where the driving current Ic is changed with respect to the luminance deterioration ratio "a", 100% luminance deterioration compensation may be achieved for a wider luminance region. Here, the display apparatus 10 according to the exemplary embodiment of the invention controls the initial sensor voltage Vso according to a change in the current Ic so as to adjust the integer $K_2$ that satisfies Equation (19) when the current Ic is changed. A specific example of the control is described below.

In an exemplary embodiment, in the case of the first model based on the fact that the resistance Rs of the optical sensor Ps of the pixel circuit 110 is inversely proportional to the luminance of the OLED OL, Equation (20) is derived by substituting Equation (4) for Equation (19) as below, for example.

$$K_{rs}\ln(V_{so}/V_{th3}) = \frac{a \cdot IcT_0}{Cs} \tag{20}$$

Provided that the initial sensor voltage Vso=−7 V, the threshold voltage Vth3 of the light emission control transistor M3=−2 V, and the current Ic=Ico in the case where the relative luminance is about 100%, Equation (20) is expressed as Equation (21) below. Herein, it is assumed that the relative luminance represents a luminance normalized so that a full-white luminance (i.e., a maximum value of a luminance) is about 100%.

$$K_{rs}\ln(7/2) = \frac{a \cdot IcoT_0}{Cs} \tag{21}$$

Provided that the current Ic and the initial sensor voltage Vso are Ic(L) and Vso(L) in the case where the relative luminance is L, Equation (22) is derived from Equation (20) as below.

$$K_{rs}\ln(-V_{so}(L)/2) = \frac{a \cdot Ic(L)T_0}{Cs} \tag{22}$$

By substituting Equation (21) for Equation (22), Equation (23) is derived as below.

$$V_{so}(L) = -2 \cdot \exp\left(\ln(7/2)\frac{Ic(L)}{Ico}\right) \tag{23}$$

In the case of the second model based on the fact that the current value Is of the optical sensor Ps is proportional to the luminance of the OLED OL, Equation (24) is derived by substituting Equation (8a) for Equation (19) as below.

$$\frac{(V_{so} - V_{th3})}{K_{is}} = \frac{a \cdot IcT_0}{Cs} \tag{24}$$

Provided that the initial sensor voltage Vso=−7 V, the threshold voltage Vth3 of the light emission control transistor M3=−2 V, and the current Ic=Ico in the case where the relative luminance is about 100%, Equation (24) is expressed as Equation (25) below.

$$\frac{(-7+2)}{K_{is}} = \frac{a \cdot IcoT_0}{Cs} \tag{25}$$

Provided that the current Ic and the initial sensor voltage Vso are Ic(L) and Vso(L) in the case where the relative luminance is L, Equation (26) is derived from Equation (24) as below.

$$\frac{(V_{so}(L)+2)}{K_{is}} = \frac{a \cdot Ic(L)T_0}{Cs} \tag{26}$$

By substituting Equation (25) for Equation (26), Equation (27) is derived as below.

$$V_{so}(L) = -2 - 5\frac{Ic(L)}{Ico} \tag{27}$$

Figure 5:
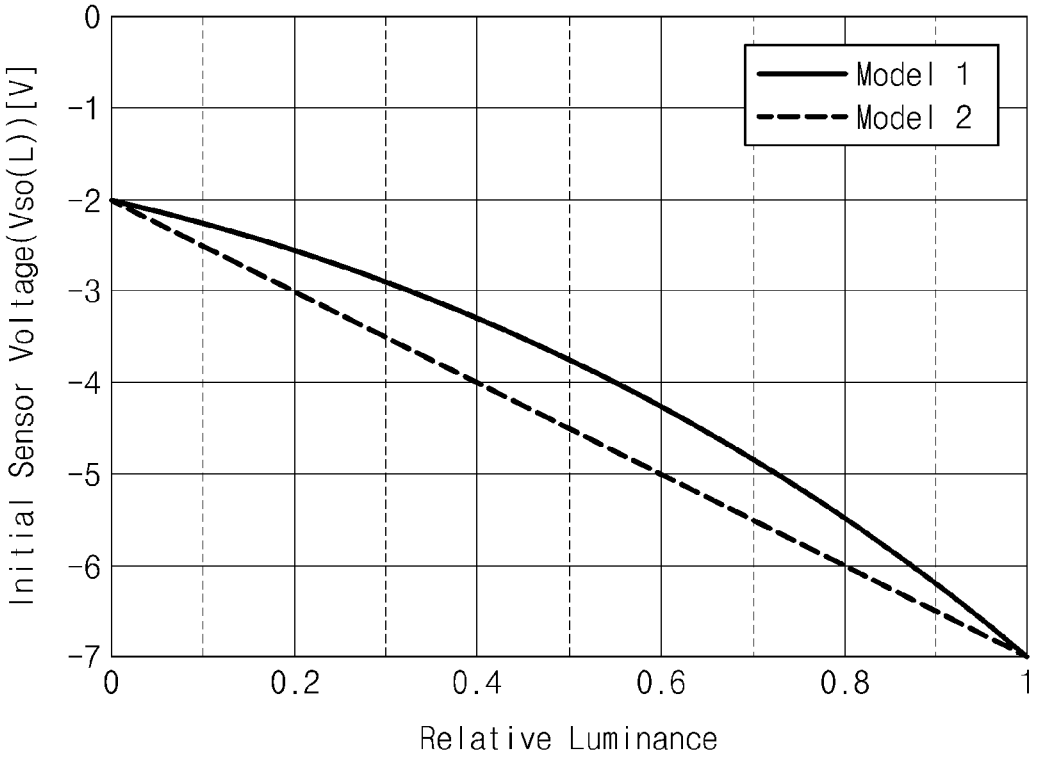
FIG. 5 is a diagram illustrating an exemplary relation between a relative luminance and an initial sensor voltage based on the relative luminance regarding the exemplary embodiment of a display apparatus according to the invention.

Here, since the current Ic is proportional to a luminance, Ic(L)/Ico corresponds to the relative luminance. FIG. 5 is a graph illustrating an exemplary relation between the relative luminance and the initial sensor voltage Vso(L) based on the relative luminance. In FIG. 5, the horizontal axis represents the relative luminance. The vertical axis represents the initial sensor voltage Vso(L) based on the relative luminance. FIG. 5 illustrates the case where the initial sensor voltage Vso=−7 V, and the threshold voltage Vth3 of the light emission control transistor M3=−2 V. In addition, in FIG. 5, model 1 and model 2 correspond to Equations (21) and (25) respectively.

Figure 6:
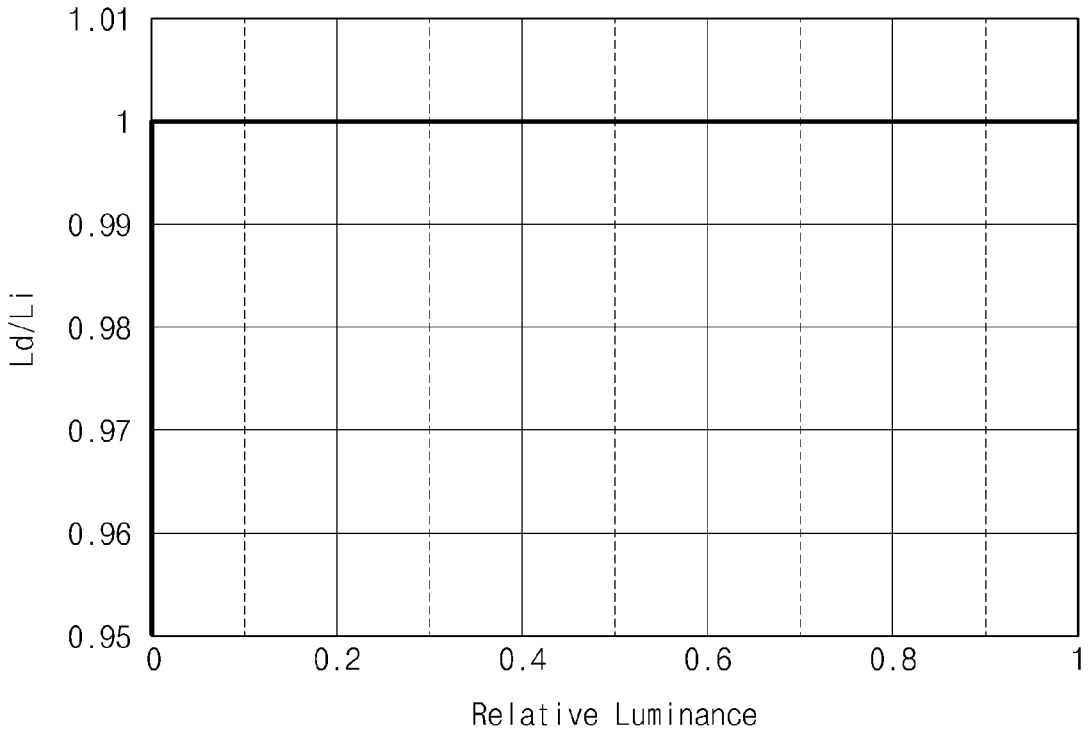
FIG. 6 illustrates an exemplary relation between a relative luminance and a post-compensation luminance deterioration ratio in the case where an initial sensor voltage based on the relative luminance is controlled as illustrated in FIG. 5.

FIG. 6 illustrates an exemplary relation between the relative luminance and the post-compensation luminance deterioration ratio Ld/Li in the case where the initial sensor voltage Vso(L) based on the relative luminance is controlled as illustrated in FIG. 5. In FIG. 6, the horizontal axis represents the relative luminance. The vertical axis represents the post-compensation luminance deterioration ratio Ld/Li.

That is, by controlling the initial sensor voltage Vso(L) based on the relative luminance as illustrated in FIG. 5, about 100% of the post-compensation luminance deterioration ratio Ld/Li (i.e., 100% luminance deterioration compensation) may be achieved theoretically for a wide range.

This example is focused on a change in the gate voltage Vg3 of the light emission control transistor M3 as time passes in the case where the initial sensor voltage Vso=−7 V, and the threshold voltage Vth3 of the light emission control transistor M3=−2 V. The light emission interval $T_0$ during one frame may not necessarily match a frame time (i.e., interval of one frame). However, it is assumed herein that the frame time approximately matches the light emission interval $T_0$ (i.e., frame time=light emission time $T_0$) to assist with an understanding of a control operation of the display apparatus 10 according to the exemplary embodiment of the invention.

Figure 7:
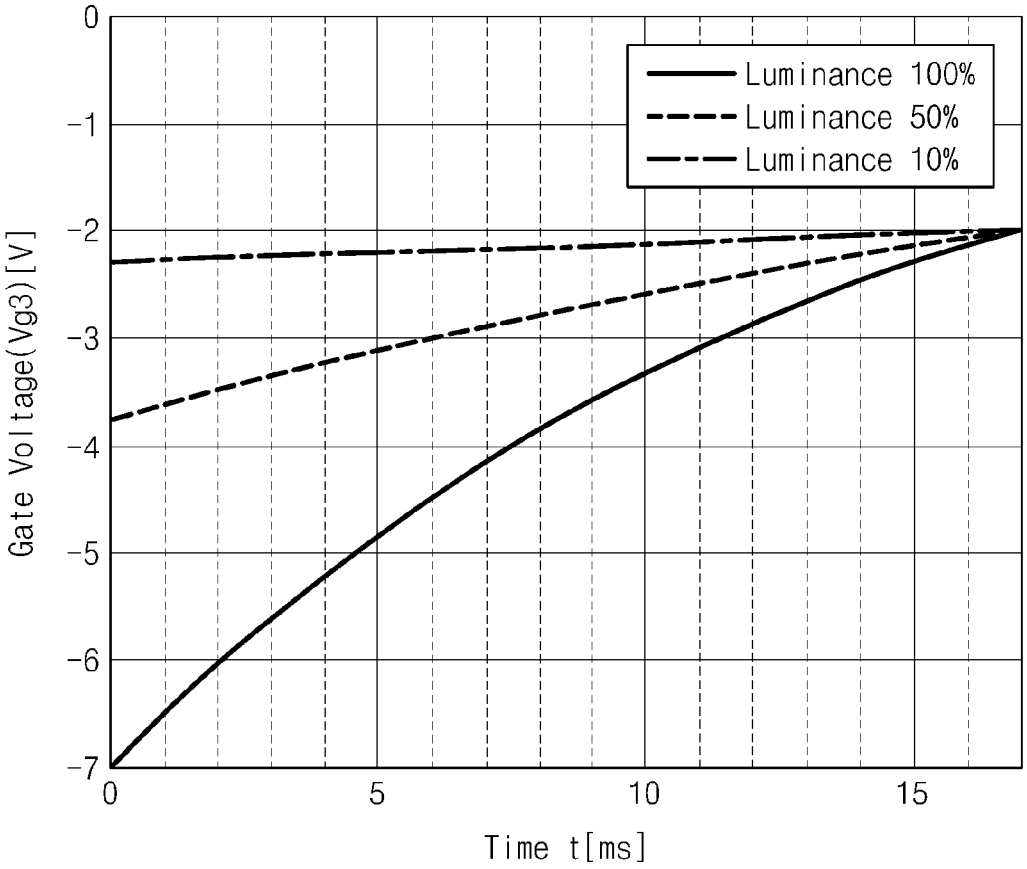
FIG. 7 is a graph exemplarily illustrating a change in a gate voltage of a light emission control transistor as time passes with respect to a first model.

In an exemplary embodiment, FIG. 7 is a graph exemplarily illustrating a change in the gate voltage Vg3 of the light emission control transistor M3 in the case of the first model based on the fact that the resistance Rs of the optical sensor Ps of the pixel circuit 110 is inversely proportional to the luminance of the OLED OL, for example. In FIG. 7, the horizontal axis represents a time t in terms of milliseconds (ms). The vertical axis represents the gate voltage Vg3 of the light emission control transistor M3. FIG. 7 shows changes in the threshold voltage Vth3 as time passes in the cases where the relative luminance is about 10%, about 50%, and about 100% respectively. The frame time $T_0$ is 16.7 ms.

Figure 8:
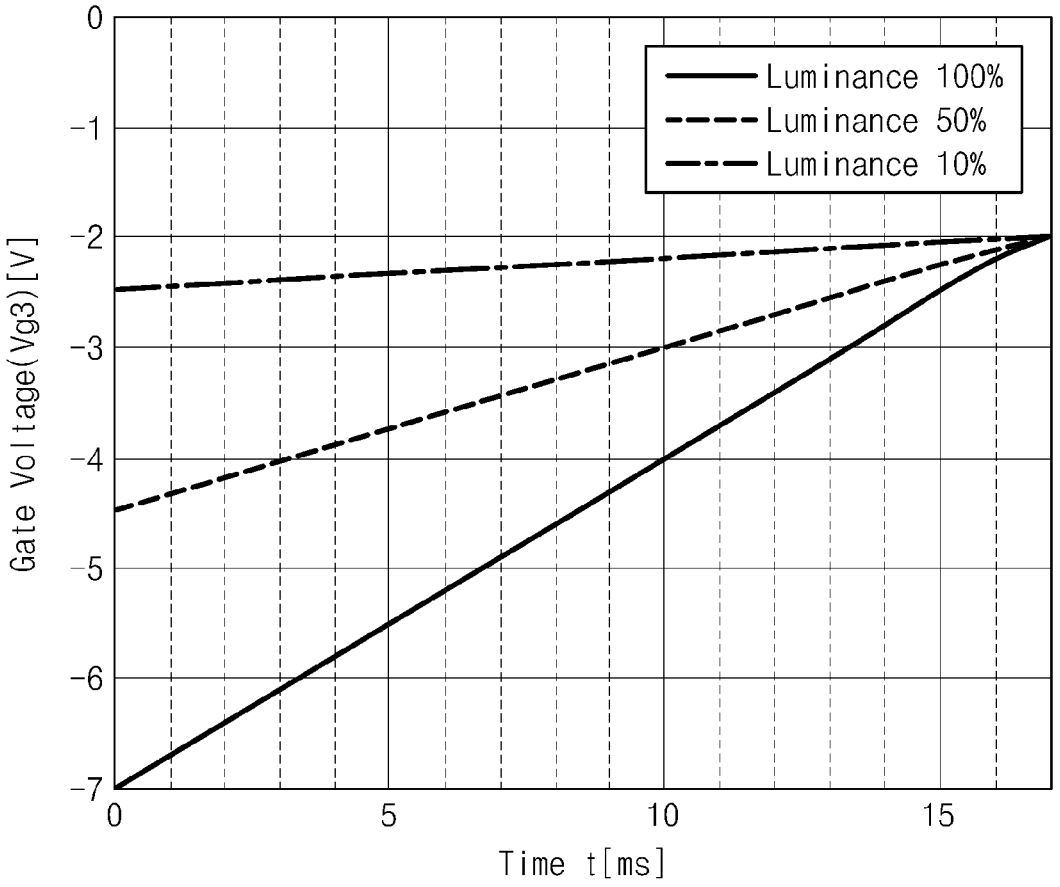
FIG. 8 is a graph exemplarily illustrating a change in a gate voltage of a light emission control transistor as time passes with respect to a second model.

FIG. 8 is a graph exemplarily illustrating a change in the gate voltage Vg3 of the light emission control transistor M3 in the case of the second model based on the fact that the current value Is of the optical sensor Ps is proportional to the luminance of the OLED OL. In FIG. 8, the horizontal axis and the vertical axis are the same as those of FIG. 7. FIG. 8 shows changes in the threshold voltage Vth3 as time passes in the cases where the relative luminance is about 10%, about 50%, and about 100% respectively.

As illustrated in FIGS. 7 and 8, it is theoretically possible to adjust the gate voltage Vg3 so that the gate voltage Vg3=−2 V when the frame time $T_0$=16.7 ms for all the cases of the relative luminance, by increasing the initial sensor voltage Vso(L) as the relative luminance decreases.

Figure 9:
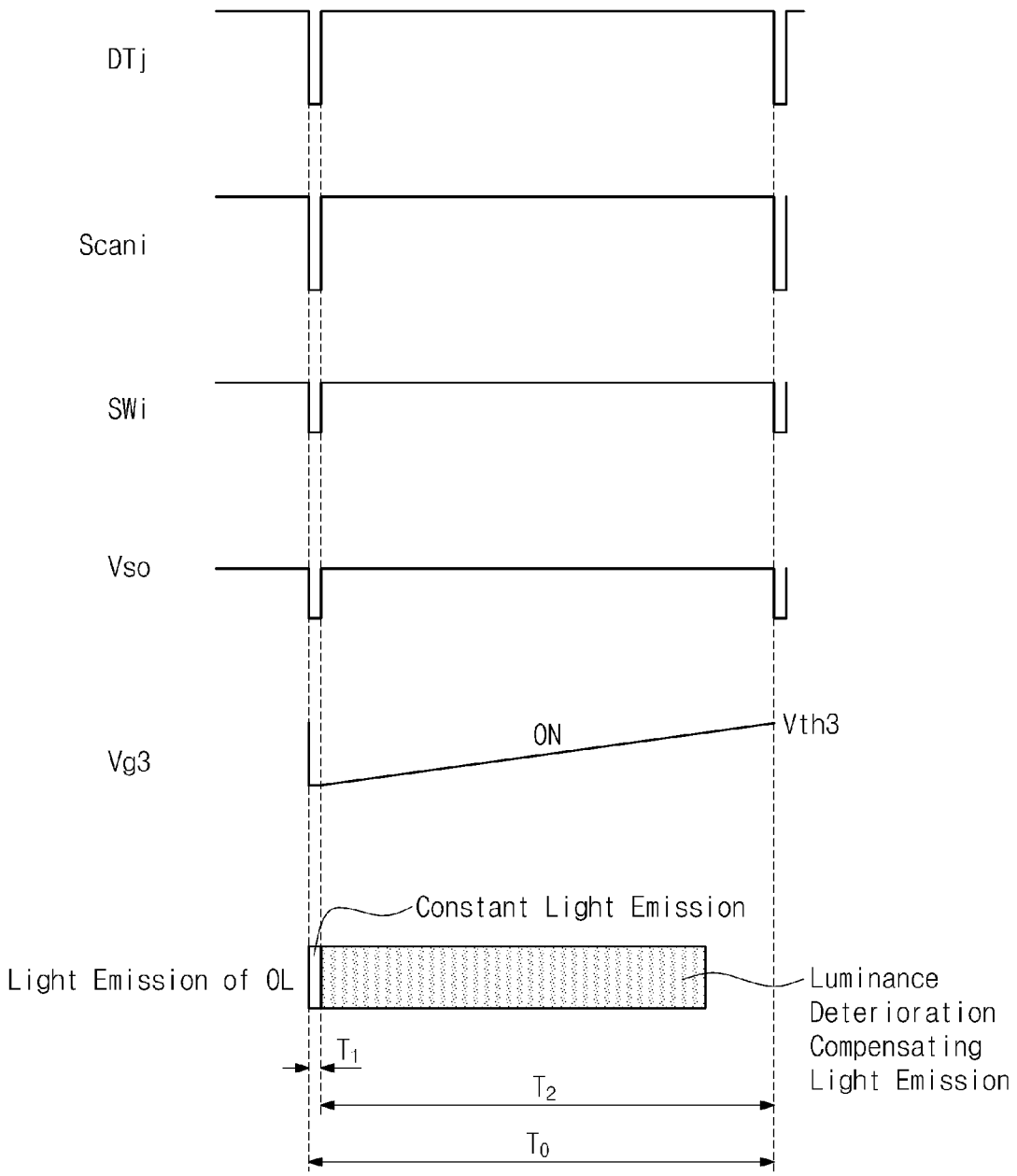
FIG. 9 is a schematic timing chart illustrating an exemplary driving timing of the exemplary embodiment of a pixel circuit according to the invention.

An example of driving timing of the pixel circuit 110 for implementing the control operation described above with reference to FIGS. 5 to 8 will be described with reference to FIG. 9. FIG. 9 is a schematic timing chart illustrating an exemplary driving timing of the pixel circuit 110 according to the exemplary embodiment of the invention. The pixel circuit 110 located at an intersection of the ith row and the jth column is described below as an example. Since the other pixel circuits 110 are the same as the exemplary pixel circuit 110, detailed descriptions of the other pixel circuits 110 are not provided.

In the example of FIG. 9, the initial sensor voltage Vso is written to the pixel circuit 110 by supplying the L-level signal SW, in synchronization with writing of data (i.e., the signal DT) to the pixel circuit 110 by virtue of supplying of the L-level signal SCAN. In the example of FIG. 9, a time taken for writing the data and the initial sensor voltage Vso is several tens of microseconds. Furthermore, in the example of FIG. 9, the gate voltage Vg3 of the light emission control transistor M3 increases from the initial sensor voltage Vso, on the basis of the initial sensor voltage Vso and the sensing current Is based on a detection result of the optical sensor Ps, as the signals SCAN and the signal SW reach an H level. Furthermore, when the gate voltage Vg3 reaches the threshold voltage Vth3 of the light emission control transistor M3, the light emission control transistor M3 is turned off, and the current IL supplied to the OLED OL becomes 0 (i.e., the OLED OL is turned off).

In the example of FIG. 9, approximately the entirety of the light emission interval $T_0$ during one frame is the luminance deterioration compensating light emission interval $T_2$, excepting the interval in which the data and the initial sensor voltage Vso are written to the pixel circuit 110. That is, it may be understood that a duty ratio of approximately 100% is obtained in the example of FIG. 9.

Described above are various characteristics due to light emission of the OLED OL in the case where the post-compensation luminance deterioration ratio Ld/Li (in other words, the luminance deterioration compensation ratio Ld/Li) is set to be maximized for the certain luminance deterioration ratio "a".

In actual operation, the luminance deterioration ratio "a" of the OLED OL is sequentially changed according to each setting of a target luminance deterioration ratio $a_0$, a design parameter of the optical sensor Ps (e.g., a sensor size, an amount of light irradiated to a sensor, a value of the sensor capacitor Cs, or the like), and the initial sensor voltage Vso. Here, a change of the post-compensation luminance deterioration ratio Ld/Li is described in detail below with respect to the actual operation. The target luminance deterioration ratio $a_0$ corresponds to an example of a "reference luminance deterioration ratio".

By substituting Equation (19) for Equations (16), (17) and (18b) with the luminance deterioration ratio "a"=$a_0$, Equations (28) to (30) are derived as below.

$$Li = a_0 K_1 Ic \tag{28}$$

$$Ld = aK_1 \frac{a_0}{a} Ic(a \geq a_0) \tag{29}$$

$$Ld = aK_1 Ic(a < a_0) \tag{30}$$

Figure 10:
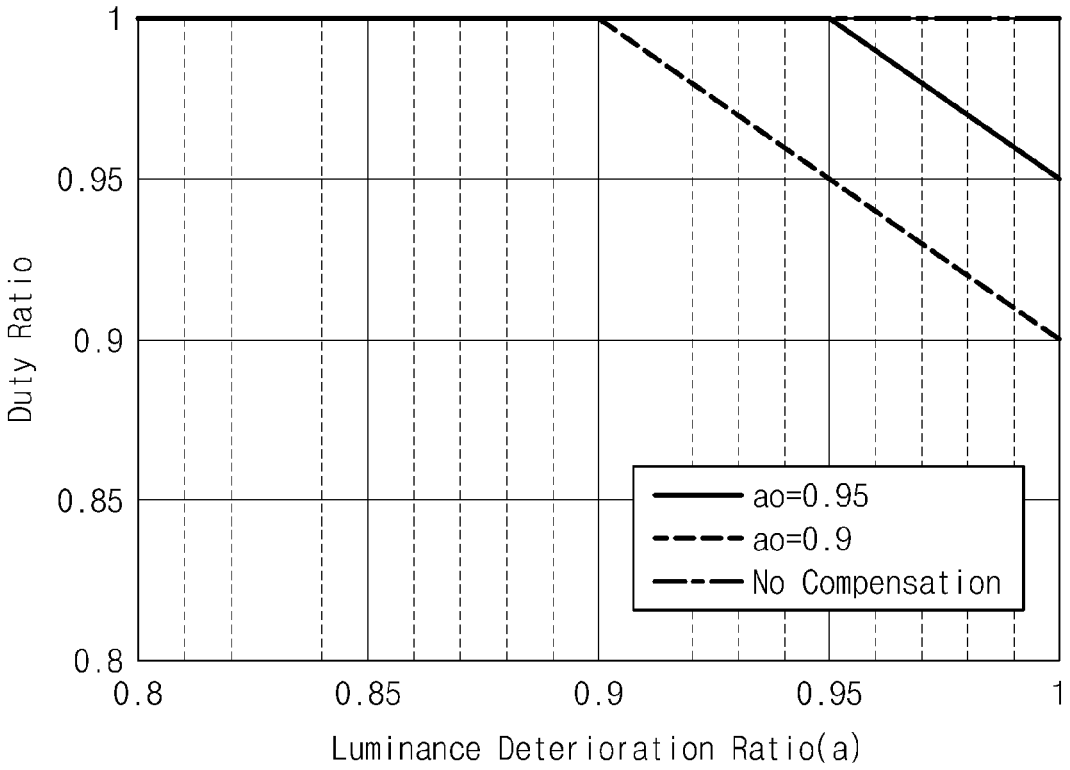
FIG. 10 illustrates an exemplary relation between a luminance deterioration ratio and a duty ratio, regarding the exemplary embodiment of a display apparatus according to the invention.

In this case, the duty ratio is changed according to a change in the luminance deterioration ratio "a" as illustrated in FIG. 10. FIG. 10 illustrates an exemplary relation between the luminance deterioration ratio "a" and the duty ratio, regarding the display apparatus 10 according to the exemplary embodiment of the invention. In FIG. 10, the horizontal axis represents the luminance deterioration ratio "a" of the OLED OL. The vertical axis represents the duty ratio. FIG. 10 illustrates the relation between the deterioration ratio "a" and the duty ratio with respect to the cases where the target luminance deterioration ratio $a_0$=0.95 and the target luminance deterioration ratio $a_0$=0.9 when compensation for the luminance deterioration is not performed.

As shown in FIG. 10, in an initial state (i.e., the luminance deterioration ratio "a"=1) of the display apparatus 10 according to the exemplary embodiment of the invention, the duty ratio is approximately equal to the target luminance deterioration ratio $a_0$. As the luminance deterioration ratio "a" decreases, the duty ratio increases, and has a maximum value of 1 with respect to the luminance deterioration "a" ($a \leq a_0$). On the basis of Equations (28) to (30), the post-compensation luminance deterioration ratio Ld/Li (i.e., the luminance deterioration compensation ratio Ld/Li) is expressed as Equations (31) and (32) below.

$$Ld/Li = 1 (a \geq a_0) \tag{31}$$

$$Ld/Li = \frac{a}{a_0} (a < a_0) \tag{32}$$

Figure 11:
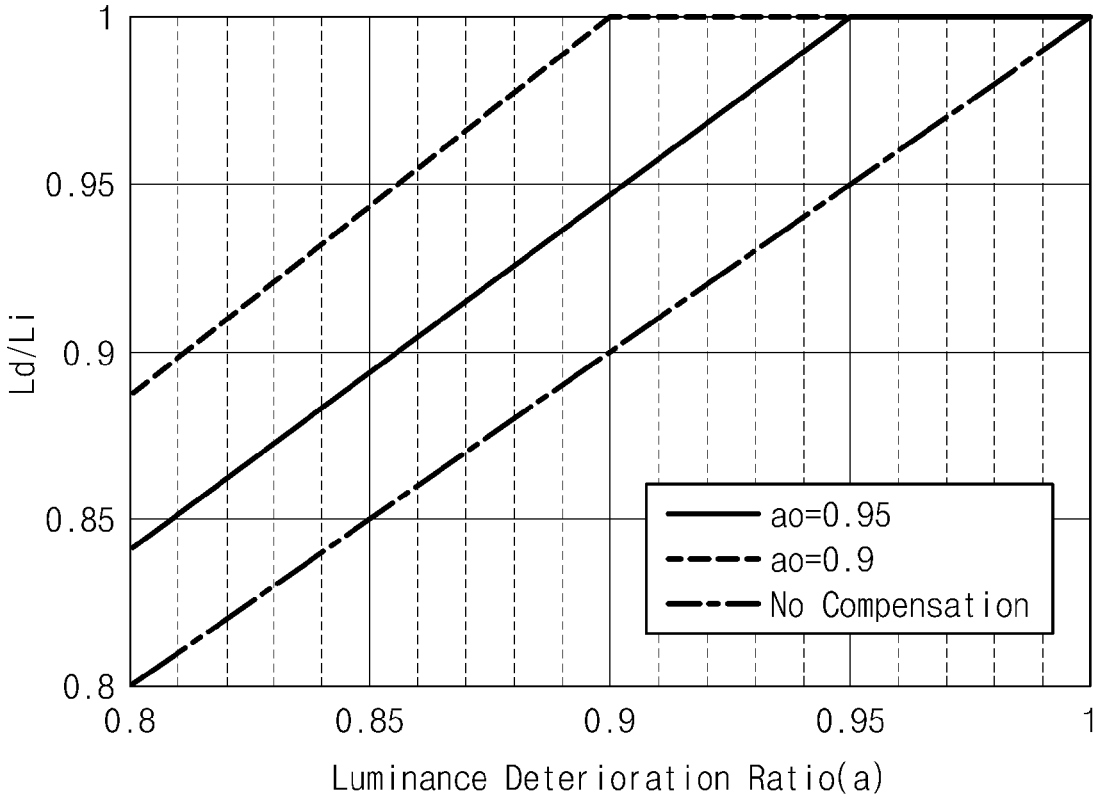
FIG. 11 illustrates an exemplary relation between a luminance deterioration ratio and a post-compensation luminance deterioration ratio, regarding the exemplary embodiment of a display apparatus according to invention.

FIG. 11 illustrates an exemplary relation between the luminance deterioration ratio "a" and the post-compensation luminance deterioration ratio Ld/Li. FIG. 11 is a graph illustrating an exemplary relation between the luminance deterioration ratio "a" and the post-compensation luminance deterioration ratio Ld/Li of the display apparatus 10 according to the exemplary embodiment of the invention. In FIG. 11, the horizontal axis represents the luminance deterioration ratio "a" of the OLED OL. The vertical axis represents the post-compensation luminance deterioration ratio Ld/Li. FIG. 11 illustrates the relation between the deterioration ratio "a" and the post-compensation luminance deterioration ratio Ld/Li with respect to the cases where the target luminance deterioration ratio $a_0$=0.95 and the target luminance deterioration ratio $a_0$=0.9 when the compensation for the luminance deterioration is not performed. In the case where the compensation for the luminance deterioration is not performed, the post-compensation luminance deterioration ratio Ld/Li represents the luminance deterioration ratio "a" of the OLED OL.

As shown in FIG. 11, the display apparatus 10 (refer to FIG. 1) according to the exemplary embodiment of the invention is capable of 100% luminance deterioration compensation during an interval in which the luminance deterioration ratio "a" of the OLED OL is changed from 1 to $a_0$.

In an interval in which the luminance deterioration ratio "a" of the OLED OL is less than a0 ($a<a_0$), the post-compensation luminance deterioration ratio Ld/Li decreases as the luminance deterioration ratio "a" decreases. However, even in the interval in which the luminance deterioration ratio "a" is less than $a_0$, the luminance deterioration due to deterioration of the OLED OL is reduced compared to that of the case where the compensation for the luminance deterioration is not performed according to the display apparatus 10 according to the exemplary embodiment of the invention.

That is, as illustrated in FIG. 11, by setting the target luminance deterioration ratio $a_0$ at a lower value, it is possible to make the post-compensation luminance deterioration ratio Ld/Li have a value of 1 over a wide range even when the duty ratio of the initial state (i.e., the luminance deterioration ratio "a"=1) is low (i.e., 100% luminance deterioration compensation may be achieved).

As described above, the optical sensor Ps may include, for example, a photodiode or a phototransistor. In general, a photodiode tends to have characteristics similar to those of the second model. A phototransistor tends to have intermediate characteristics between those of the first model and those of the second model.

In the above description, a P-channel-type transistor is exemplarily used as each transistor of the pixel circuit 110 of FIG. 2, but an exemplary embodiment of the invention is not limited thereto. In an exemplary embodiment, an N-channel-type transistor may be used as each transistor of the pixel circuit 110 of FIG. 2. In this case, relations among signals in terms of potential may be modified, as appropriate, according to characteristics of each transistor.

A principle of operation of the display apparatus 10 for compensating for the luminance deterioration of the OLED OL has been described on the basis of simple model equations with reference to FIGS. 2 and 5 to 11.

<5. Method of Setting Initial Sensor Voltage Vso>

Figure 12:
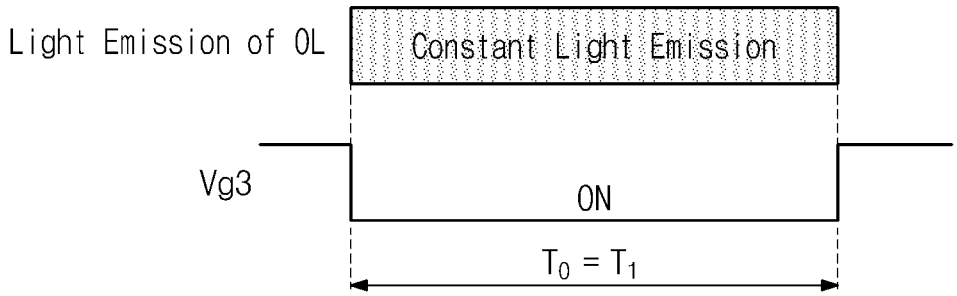
FIG. 12 is a diagram illustrating an exemplary method of setting an initial sensor voltage for each relative luminance in the exemplary embodiment of a display apparatus according to the invention.
Figure 13:
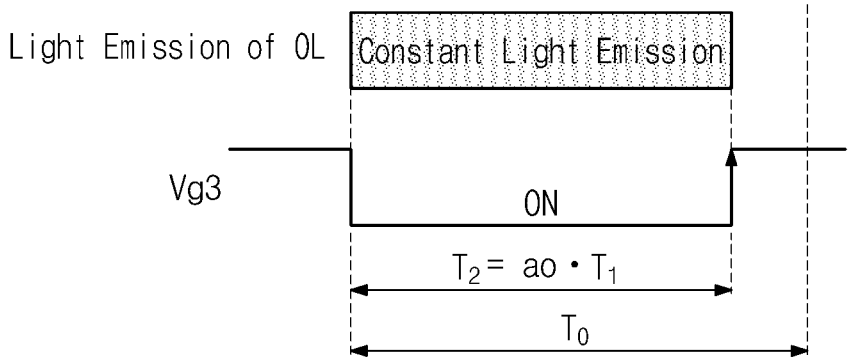
FIG. 13 is a diagram illustrating an exemplary method of setting an initial sensor voltage for each relative luminance in the exemplary embodiment of a display apparatus according to the invention.

An exemplary method of setting the initial sensor voltage Vso is described below. An exemplary method of setting the initial sensor voltage Vso for each relative luminance according to light emission characteristics of the OLED OL will be described with reference to FIGS. 12 and 13. FIGS. 12 and 13 are diagrams illustrating an exemplary method of setting the initial sensor voltage Vso for each relative luminance in the display apparatus 10 (refer to FIG. 1) according to the exemplary embodiment of the invention.

According to the method of setting the initial sensor voltage Vso for each relative luminance, the initial sensor voltage Vso is adjusted while measuring the luminance of the OLED OL for each relative luminance.

In detail, as illustrated in FIG. 12, the light emission interval $T_0$ during one frame is controlled so that a current state is a constant light emission state (i.e., $T_0=T_1$) for each gradation (i.e., each relative luminance), and the luminance L of the OLED OL of this moment is measured. The luminance L measured at this moment is that of the case where the duty ratio is about 100% as illustrated in FIG. 12.

Thereafter, for the same gradation, the luminance L of the OLED OL is adjusted so as to be $a_0$ times larger than the luminance of the case where the duty ratio is about 100%, while changing the initial sensor voltage Vso with the constant light emission interval $T_1$=0 as illustrated in FIG. 13. That is, in the case where the target luminance deterioration $a_0$=0.95, the initial sensor voltage Vso is adjusted so as to be 0.95 times larger than the luminance of the case where the duty ratio is about 100%. In this case, as illustrated in FIG. 13, the luminance deterioration compensating light emission interval $T_2$ and the light emission period $T_0$ during one frame satisfy $T_2=a_0 \cdot T_0$, and the duty ratio is about 95%.

As described above with reference to FIG. 10, in the display apparatus 10 (refer to FIG. 1) according to the exemplary embodiment of the invention, the duty ratio is approximately equal to the target luminance deterioration ratio $a_0$ in the initial state (i.e., the luminance deterioration ratio "a" of the OLED OL=1). That is, with the constant light emission interval $T_1$=0, the initial sensor voltage Vso is adjusted so that the luminance L of the OLED OL is $a_0$ times larger than the luminance of the case where the duty ratio is about 100%. Accordingly, the target luminance deterioration ratio $a_0$ is set. The initial sensor voltage Vso is specified for each gradation by performing the above-mentioned adjustment for each gradation appropriately.

Furthermore, the above-mentioned adjustment is not necessarily required to be performed for all gradations. In an exemplary embodiment, the above-mentioned adjustment may be performed for some gradations, and the initial sensor voltage Vso may be derived through interpolation for the other gradations. In order to more accurately compensate for the luminance deterioration of the OLED OL, the above-mentioned adjustment may be performed for all gradations (all relative luminances).

An exemplary method of setting the initial sensor voltage Vso has been described with reference to FIGS. 12 and 13.

<6. Summary>

As described above, the display apparatus 10 (refer to FIG. 1) according to the exemplary embodiment of the invention includes a control circuit for receiving the signal DT based on luminance of emitted light (gradation) to control the luminance of the OLED OL and a control circuit for receiving the initial sensor voltage Vso to compensate for the amount of light emission of the OLED OL. On the basis of this configuration, the light emission interval $T_0$ of one frame is divided into the constant light emission interval $T_1$ and the luminance deterioration compensating light emission interval $T_2$ so that the display apparatus 10 according to the exemplary embodiment of the invention performs control according to the intervals. That is, the display apparatus 10 according to the exemplary embodiment of the invention controls the luminance of the OLED OL according to the luminance of emitted light (or gradation) during the constant light emission interval $T_1$. Furthermore, the display apparatus 10 controls the length of the luminance deterioration compensating light emission interval $T_2$ that follows the constant light emission interval $T_1$, so as to compensate for the amount of light emitted from the OLED OL according to the amount of luminance deterioration of the OLED OL (i.e., compensate for the luminance deterioration).

By virtue of this configuration, the display apparatus 10 according to the exemplary embodiment of the invention is able to individually control the compensation for the luminance deterioration of the OLED OL and the luminance of the OLED OL according to the luminance of emitted light (or gradation). That is, according to the display apparatus 10 according to the exemplary embodiment of the invention, the luminance of the OLED OL may be set and a light emission amount may be compensated according to the amount of luminance deterioration of the OLED OL.

Furthermore, according to the display apparatus 10 according to the exemplary embodiment of the invention, the length of the constant light emission interval $T_1$ may be appropriately changed. Therefore, according to the display apparatus 10 according to the exemplary embodiment of the invention, the length of the constant light emission interval $T_1$ may be appropriately set according to an operation type of the display apparatus 10, so that the occurrence of a false contour may be avoided.

Moreover, the display apparatus 10 according to the exemplary embodiment of the invention controls the initial sensor voltage Vso according to the luminance of the OLED OL (in other words, a change of the current Ic). By virtue of this configuration, the display apparatus 10 according to the exemplary embodiment of the invention is able to control the post-compensation luminance deterioration ratio Ld/Li so that the post-compensation luminance deterioration ratio Ld/Li is 1 during an interval in which the luminance deterioration ratio "a" of the OLED OL is not greater than the target luminance deterioration ratio $a_0$ (i.e., capable of 100% luminance deterioration compensation).

Moreover, according to the display apparatus 10 according to the exemplary embodiment of the invention, design parameters of the optical sensor Ps (e.g., a sensor size, an amount of light irradiated to a sensor, a value of the sensor capacitor Cs, or the like) are appropriately adjusted according to sensitivity characteristics of the optical sensor Ps, so as to appropriately adjust the luminance deterioration compensating light emission interval $T_2$ according to the target luminance deterioration ratio $a_0$. That is, according to the display apparatus 10 according to the exemplary embodiment of the invention, the luminance deterioration compensating light emission interval $T_2$ may be appropriately set according to an operation type of the display apparatus 10.

Furthermore, according to the display apparatus 10 according to the exemplary embodiment of the invention, in an interval in which the luminance deterioration ratio "a" of the OLED OL is less than $a_0$ ($a<a_0$), the post-compensation luminance deterioration ratio Ld/Li decreases as the luminance deterioration ratio "a" decreases. However, according to the display apparatus 10 according to the exemplary embodiment of the invention, in the interval in which the luminance deterioration ratio "a" is less than $a_0$, the luminance deterioration due to deterioration of the OLED OL may be reduced compared to that of the case where the compensation for the luminance deterioration is not performed.

Furthermore, according to the display apparatus 10 according to the exemplary embodiment of the invention, the duty ratio of the initial state (i.e., a state in which the luminance deterioration ratio "a"=1) may be appropriately adjusted according to a setting of the target luminance deterioration ratio $a_0$. Furthermore, according to the display apparatus 10 according to the exemplary embodiment of the invention, the duty ratio is 1 when the deterioration ratio "a"$<a_0$ as the duty ratio increases due to the deterioration of the OLED OL. That is, according to the display apparatus 10 according to the exemplary embodiment of the invention, the duty ratio is controlled so as to be constantly equal to or larger than a value determined according to the target luminance deterioration ratio $a_0$. Therefore, according to the display apparatus 10 according to the exemplary embodiment of the invention, the target luminance deterioration ratio $a_0$ is appropriately set according to an operation type of the display apparatus 10 so that the occurrence of a false contour may be avoided.

In addition, according to the display apparatus 10 according to the exemplary embodiment of the invention, the target luminance deterioration ratio $a_0$ may be appropriately adjusted through the simple procedure described above in "5. Method of setting initial sensor voltage Vso". That is, according to the display apparatus 10 according to the exemplary embodiment of the invention, control for luminance deterioration compensation based on the target luminance deterioration ratio $a_0$ may be appropriately performed according to an operation type of the display apparatus 10.

As described above, according to an exemplary embodiment of the invention, the occurrence of a false contour may be prevented. Furthermore, an exemplary embodiment of the invention may provide a display apparatus and a display method for desirably compensating for the amount of light emission of a light-emitting element according to the amount of deterioration of the light-emitting element for each pixel.

The above-disclosed subject matter is to be considered illustrative and not restrictive, and the appended claims are intended to cover all such modifications, enhancements, and other exemplary embodiments, which fall within the true spirit and scope of the invention. Thus, to the maximum extent allowed by law, the scope of the invention is to be determined by the broadest permissible interpretation of the following claims and their equivalents, and shall not be restricted or limited by the foregoing detailed description.

What is claimed is:

1. A display apparatus including pixel circuits arranged in a matrix, each of the pixel circuits comprising:

a light-emitting element which emits light with a luminance based on an amount of current;

an optical sensor which detects the luminance of the light emitted from the light-emitting element; and a compensation control circuit which controls the amount of the current supplied to the light-emitting element on the basis of a detection result of the optical sensor and a second voltage applied in a second interval different from a first interval with a predetermined length during a light emission interval of the light-emitting element, wherein, in the first interval, the light-emitting element is allowed to constantly emit light with a luminance based on a first voltage, wherein each of the pixel circuits comprises a driving transistor for controlling an amount of current which flows between a source and a drain thereof on the basis of the first voltage applied to a gate terminal of the driving transistor, and wherein the amount of the current supplied to the light-emitting element is controlled on the basis of the driving transistor and the compensation control circuit.

2. The display apparatus of claim 1, wherein the compensation control circuit comprises:

a capacitor which maintains the second voltage applied; and a light emission control transistor which controls an amount of current which flows between a source and a drain thereof on the basis of a gate voltage determined according to the second voltage maintained in the capacitor and the detection result of the optical sensor during the second interval.

3. The display apparatus of claim 2, wherein a discharge interval of the second voltage maintained in the capacitor is wherein a length of the second interval is controlled on the basis of the discharge interval.

4. The display apparatus of claim 3, wherein the optical sensor is connected in parallel to the capacitor, wherein one terminal of the optical sensor and one terminal of the capacitor are connected to a gate terminal of the light emission control transistor, and wherein the second voltage applied to the gate terminal of the light emission control transistor is maintained in the capacitor during the first interval.

5. The display apparatus of claim 4, further comprising:

a switching element which determines whether to apply the second voltage to the gate terminal of the light emission control transistor, wherein, in the first interval, the switching element is turned on, and wherein, in the second interval, the switching element is turned off, so that the gate terminal of the light emission control transistor is floated.

6. The display apparatus of claim 1, wherein the driving transistor is disposed at a front stage of the compensation control circuit, and wherein the compensation control circuit controls the amount of the current supplied to the light-emitting element on the basis of current supplied through the driving transistor.

7. A method for displaying an image on a display apparatus comprising pixel circuits arranged in a matrix, each of the pixel circuits comprising a light-emitting element which emits light with a luminance based on an amount of current and an optical sensor which detects the luminance of the light emitted from the light-emitting element, the method comprising:

making the light-emitting element emit light constantly with a luminance based on a first voltage for controlling the luminance of the light-emitting element in a first interval with a predetermined length during a light emission interval of the light-emitting element; and controlling the amount of the current supplied to the light-emitting element on the basis of a detection result of the optical sensor and a second voltage applied in a second interval different from the first interval, wherein each of the pixel circuits comprises a driving transistor for controlling an amount of current which flows between a source and a drain thereof on the basis of the first voltage applied to a gate terminal of the driving transistor, and wherein the amount of the current supplied to the light-emitting element is controlled on the basis of the driving transistor and the compensation control circuit.

8. A display apparatus including pixel circuits arranged in a matrix, each of the pixel circuits comprising:

a light-emitting element which emits light with a luminance based on an amount of current;

an optical sensor which detects the luminance of the light emitted from the light-emitting element; and a first control circuit which receives a first voltage for controlling the luminance of the light-emitting element to control a first current amount for enabling the light-emitting element to emit the light; and a second control circuit which receives a second voltage determined according to the first voltage, and control a second current amount supplied to the light-emitting element on the basis of a detection result of the optical sensor and the second voltage based on the first current amount, wherein the first control circuit comprises a driving transistor for controlling an amount of current which flows through a source and a drain thereof on the basis of the first voltage applied to a gate terminal of the driving transistor, and wherein the amount of the current supplied to the light-emitting element is controlled on the basis of the driving transistor and the second control circuit.

9. The display apparatus of claim 8, wherein the second control circuit controls a light emission interval of the light-emitting element during one frame according to the second voltage.

10. The display apparatus of claim 8, wherein the second voltage based on the first voltage is preset according to a predetermined reference luminance deterioration ratio.

11. The display apparatus of claim 10, wherein the second voltage based on the first voltage is preset so that a light emission interval of the light-emitting element during one frame becomes a preset interval when a luminance deterioration ratio of the light-emitting element is the predetermined reference luminance deterioration ratio.

12. The display apparatus of claim 10, wherein the second voltage is preset so that the light-emitting element emits light with a predetermined duty ratio when a luminance deterioration ratio of the light-emitting element is the predetermined reference luminance deterioration ratio.

13. The display apparatus of claim 8, wherein the second control circuit comprises:

a capacitor which maintains the second voltage applied; and a light emission control transistor which controls an amount of current which flows between a source and a drain thereof on the basis of a gate voltage determined according to the second voltage maintained in the capacitor and the detection result of the optical sensor.

14. The display apparatus of claim 13, wherein a discharge interval of the second voltage maintained in the capacitor is controlled according to the detection result of the optical sensor, and wherein a length of a second interval during one frame is controlled on the basis of the discharge interval.

15. The display apparatus of claim 8, wherein the driving transistor is disposed at a front stage of the second control circuit, and wherein the second control circuit controls the second current amount supplied to the light-emitting element on the basis of the first current amount supplied through the driving transistor.

* * * * *